US007513788B2

(12) United States Patent
Camelio

(10) Patent No.: US 7,513,788 B2
(45) Date of Patent: Apr. 7, 2009

(54) CONNECTOR AND METHOD OF MATING SAME WITH A CORRESPONDING CONNECTOR

(75) Inventor: David J. Camelio, Foxborough, MA (US)

(73) Assignee: Winchester Electronics Corporation, Wallingford, CT (US)

( * ) Notice: Subject to any disclaimer, the term of this patent is extended or adjusted under 35 U.S.C. 154(b) by 0 days.

(21) Appl. No.: 11/961,623

(22) Filed: Dec. 20, 2007

(65) Prior Publication Data

US 2008/0096405 A1 Apr. 24, 2008

Related U.S. Application Data

(63) Continuation of application No. 11/590,870, filed on Nov. 1, 2006, now Pat. No. 7,322,846.

(60) Provisional application No. 60/733,261, filed on Nov. 4, 2005.

(51) Int. Cl.
*H01R 13/627* (2006.01)

(52) U.S. Cl. ..... 439/352

(58) Field of Classification Search ..... 439/352, 439/350, 357, 578
See application file for complete search history.

(56) References Cited

U.S. PATENT DOCUMENTS 3,745,514 A * 7/1973 Brishka ..... 439/848
3,953,098 A * 4/1976 Avery et al. ..... 439/258
4,017,139 A * 4/1977 Nelson ..... 439/352
4,138,181 A * 2/1979 Hacker et al. ..... 439/258
4,426,127 A 1/1984 Kubota
4,846,714 A * 7/1989 Welsby et al. ..... 439/348
4,941,846 A * 7/1990 Guimond et al. ..... 439/578
5,435,745 A * 7/1995 Booth ..... 439/584
5,785,545 A * 7/1998 Holt ..... 439/352
6,394,662 B1 * 5/2002 Foster ..... 385/60
6,464,527 B2 10/2002 Volpe et al.
6,475,014 B2 * 11/2002 Tsuji et al. ..... 439/352
6,595,793 B2 * 7/2003 Tsuji et al. ..... 439/352
6,645,011 B2 11/2003 Schneider et al.
6,692,286 B1 2/2004 De Cet
6,695,636 B2 2/2004 Hall et al.
6,709,289 B2 3/2004 Huber et al.
6,848,931 B2 * 2/2005 McMullen et al. ..... 439/350

OTHER PUBLICATIONS

Winchester Electronics, New Product Announcement, "Quick Connect SMA™ Connectors", Oct. 2005, two pages.

* cited by examiner

*Primary Examiner*—Chandrika Prasad
(74) *Attorney, Agent, or Firm*—Rothwell, Figg, Ernst & Manbeck, P.C.

(57) ABSTRACT

The invention relates to a connector that can be easily mated to a jack connector.

18 Claims, 5 Drawing Sheets

CONNECTOR AND METHOD OF MATING SAME WITH A CORRESPONDING CONNECTOR

CROSS-REFERENCE TO RELATED APPLICATIONS

The present application is a continuation of application Ser. No. 11/590,870, filed Nov. 1, 2006 (now U.S. Pat. No. 7,322,846), which claims the benefit of U.S. Provisional Patent Application No. 60/733,261, filed on Nov. 4, 2005, which are incorporated herein.

BACKGROUND OF THE INVENTION

1. Field of the Invention

The invention relates to connectors.

2. Discussion of the Background

There is a need for electrical connectors that can be used in applications requiring RF or high-speed digital electrical signals.

SUMMARY OF THE INVENTION

In one aspect, the invention provides a quick connect (QC) connector. In one embodiment, the QC connector includes: a generally cylindrical body; a generally cylindrical lock ring surrounding at least a portion of the body, the lock ring comprising a finger, wherein the lock ring is moveable relative to the body along an axis that is generally parallel with a longitudinal axis of the body between a first position and a second position; a spring disposed in a space between the lock ring and the body, wherein, when the lock ring is in the second position, the spring is compressed; and a shroud surrounding at least part of the lock ring, wherein the shroud is moveable relative to the body and relative to the lock ring along an axis that is generally parallel with the longitudinal axis of the body between an open position, in which the shroud does not exert an appreciable inward force on the finger, and a closed position, in which the shroud exerts an appreciable inward force on the finger that causes the finger to bend inwardly.

In another aspect, the invention provides a method for mating a jack connector with a quick connect (QC) connector, wherein the QC connector comprises a generally cylindrical body, a generally cylindrical lock ring surrounding at least a portion of the body, the lock ring comprising a finger tending to flare outwardly, a spring disposed between the lock ring and the body, and a shroud surrounding at least part of the lock ring, wherein the shroud is moveable along an axis that is generally parallel with a longitudinal axis of the body. In one embodiment, the method includes: (a) positioning the QC connector in front of the jack connector; (b) exerting a force on the shroud in the direction of the jack connector so that a mating face of the body enters into a cavity defined by the jack connector; (c) after performing step (b), exerting a force on the shroud in the direction of the jack connector to cause the lock ring to (i) move in the direction of the jack connector relative to the body and (ii) compress the spring; and (d) after performing step (c), exerting a force on the shroud in the direction of the jack connector to cause the shroud to move in the direction of the jack connector relative to the lock ring so that the shroud exerts an inward force on the finger, thereby causing the finger to bend inwardly such that a lip of the finger engages a protuberance of the jack connector.

In yet another aspect, the invention provides a method for un-mating a quick connect (QC) connector from a jack connector. In one embodiment, the method includes the steps of:

(a) gripping a shroud of the QC connector; (b) exerting a force on the shroud in a direction away from the jack connector so that the shroud moves relative to a lock ring that surrounds at least a portion of the body of the QC connector in the direction to allow a finger of the lock ring to move outwardly and disengage a member of the jack connector to which it was engaged, wherein, after the finger disengages the member, a spring automatically causes the lock ring to move in the direction away from the jack connector; and (c) disengaging a contact housed within the body of the QC connector from a contact of the jack connector.

The above and other features and advantages of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, help illustrate various embodiments of the present invention and, together with the description, further serve to explain the principles of the invention and to enable a person skilled in the pertinent art to make and use embodiments of the invention. In the drawings, like reference numbers indicate identical or functionally similar elements.

DETAILED DESCRIPTION OF PREFERRED EMBODIMENTS

Figure 1:
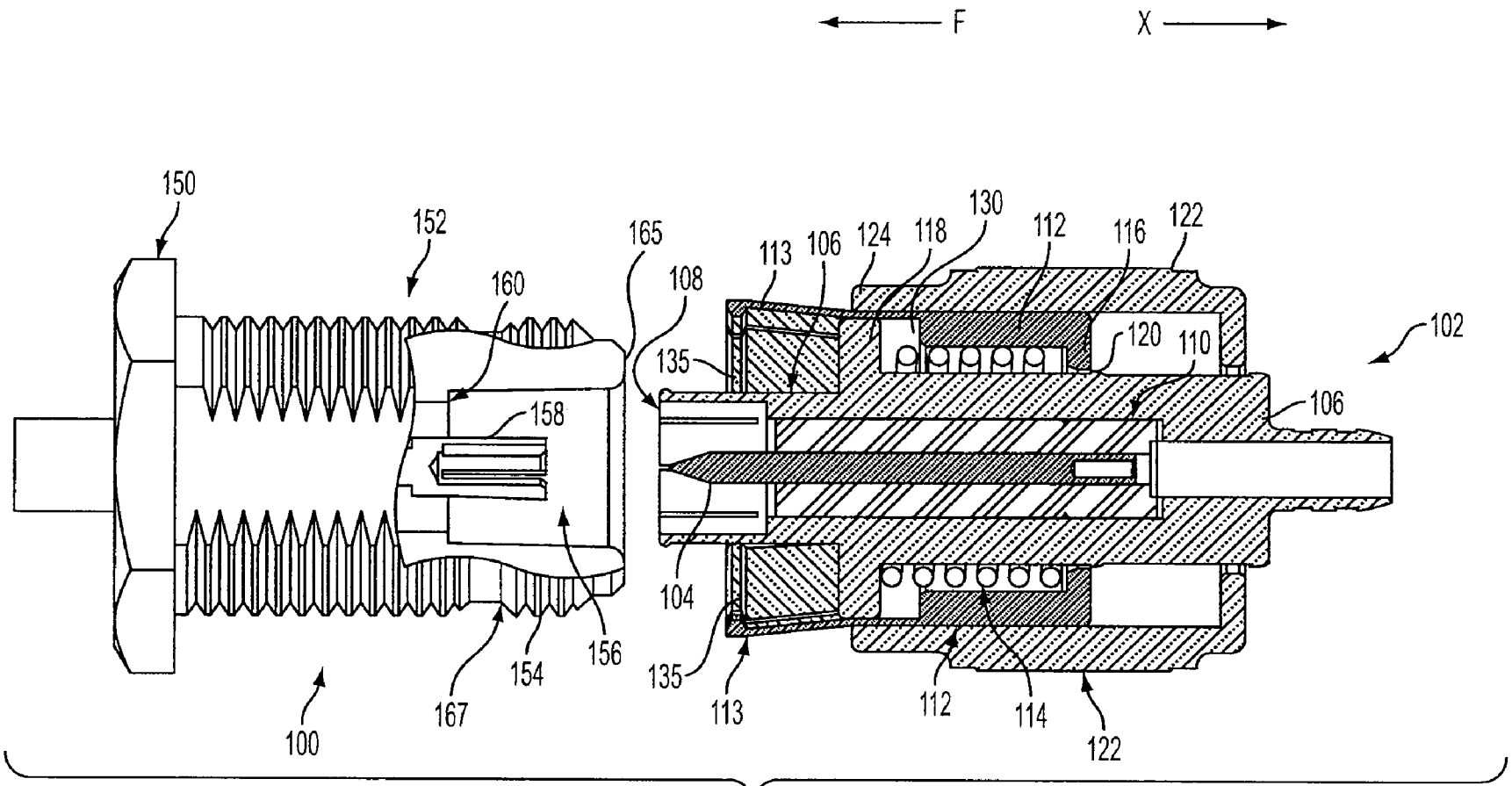
FIG. 1 is a cross-sectional, side view of a connector system 100 according to an embodiment of the invention.

FIG. 1 is a cross-sectional, side view of a connector system 100 according to an embodiment of the invention. Connector system 100 includes a first connector 102 (a.k.a., "QC connector 102") and a second connector 104 (a.k.a., "jack connector 150"). Connector 102 is designed to mate with connector 150. FIG. 1 shows connectors 102 and 150 in an un-mated configuration.

In some embodiments, jack connector 150 comprises a generally cylindrical member 152 that may have external threads 154, and the distal portion of member 152 defines a cavity 156. Disposed in cavity 156 may be a contact 158 (e.g., a female contact) for mating with a contact 104 (e.g., a male contact) 104 of QC connector 102. Preferably, a mating face 160 is formed at the rear end of cavity 156.

In some embodiments, QC connector 102 includes a body 106 having a front mating face 108. Preferably, body 106 defines a cavity in which contact 104 is housed. Preferably, an insulator 110 electrically insulates contact 104 from body 106.

In some embodiments, QC connector 102 also includes a generally elongate, ring shaped outer contact or lock ring 112 that surrounds a portion of body 106. The front portion of lock ring 112 may include resilient fingers 113. Resilient fingers 113 tend to flare outwardly as shown in FIG. 1.

Part of the body that is surrounded by lock ring 112 has an outer diameter that is less than the inner diameter of lock ring 112. Thus, there exists a space between an inner surface of lock ring 112 and an outer surface of body 106. Preferably, a spring 114 is disposed within this space and positioned between a shoulder 116 of lock ring 112 and a shoulder 118 of body 106. Body 160 may include a retaining step 120 positioned just to the rear of shoulder 116 for limiting the axial movement of lock ring 112.

As shown in FIG. 1, QC connector 102 also may include a ring shaped shroud 122 that surrounds a portion of lock ring 112. Preferably, shroud 122 can move relative to body 106 between an open position (shown in FIG. 1) and a closed position (see FIG. 3).

To mate connector 150 with connector 102, shroud 122 should be positioned in the open position. That is, if shroud 122 is in the closed position, shroud 122 should be moved towards the rear of body 106 so that the front tip 124 of shroud does not exert an inward force on fingers 113, thereby allowing fingers 113 to flare outwardly.

With shroud 122 disposed in the open position, the user should grip shroud 122 and then, while gripping shroud 122, exert an axial force (F) on shroud 122 in the direction of connector 150 so that mating face 108 of body 106 enters cavity 156. As a result of the user exerting force F on shroud, shroud will exert an axial force on lock ring 112, which force will be in the direction of connector 150. As a result of the shroud 122 exerting the force on lock ring 112, lock ring 112 will exert an axial force on body 106 through spring 114, which force will be in the direction of connector 150, and, due to friction, lock ring 112 will exert an axial resistive force on shroud 122, which resistive force is in a direction opposite of force F and which has a magnitude equal or about equal to force F.

Figure 2:
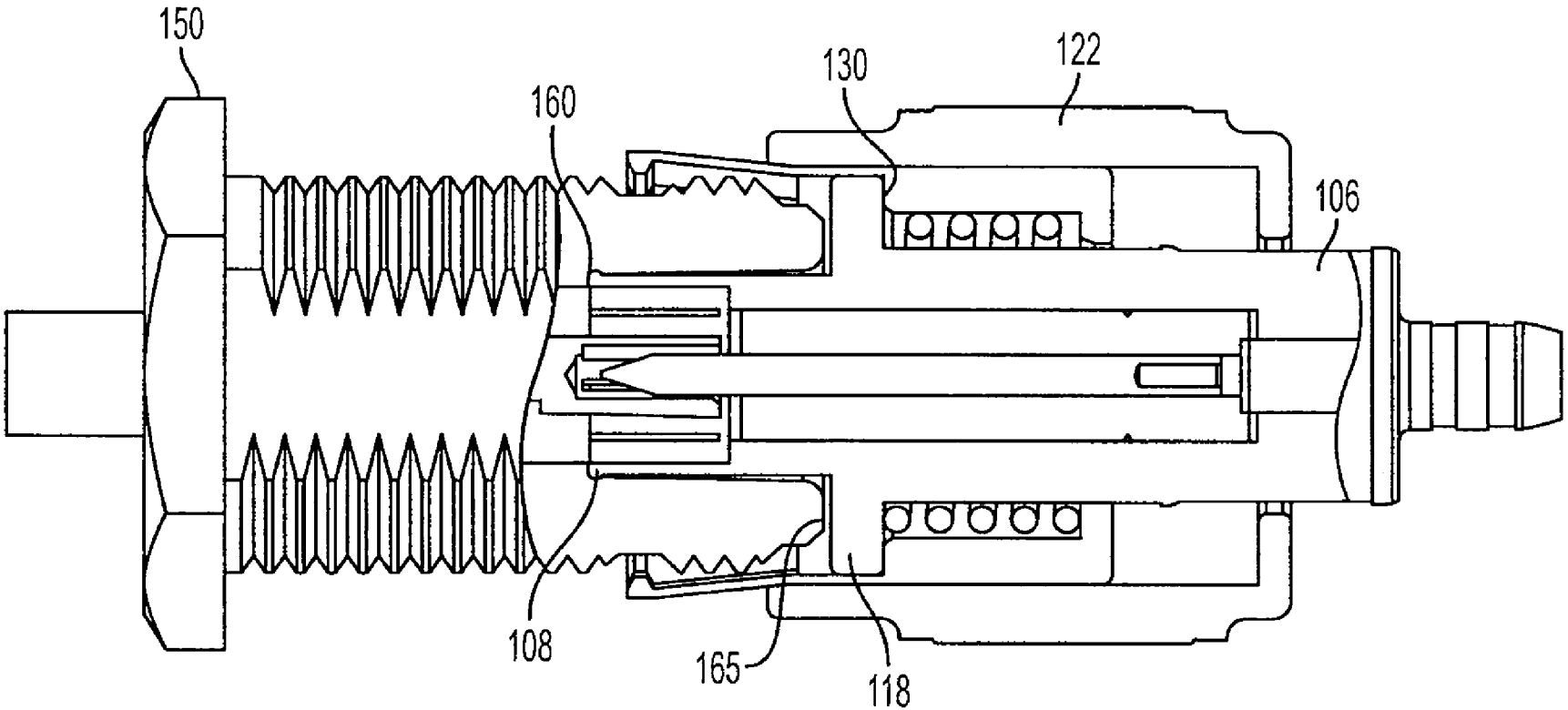
FIG. 2 shows connectors 102 and 150 in a partially mated state.

When mating face 108 is pushed into cavity 156, at some point the leading edge 165 of connector 150 will abut shoulder 118 (see FIG. 2) and/or mating face 108 will abut mating face 160. When this happens, the user should continue to push shroud 122 in the direction of connector 150, which will cause connector 150 to exert a force on body 106 in the opposite direction that the user is pushing connector 102 (assuming that jack connector 150 is not able to move in the direction in which the user is pushing connector 102). In such a case, when connector 150 pushes on body 106, body 106 will no longer be able to move in the direction of the axial force applied by the user on shroud 122.

Because body 106 will no longer be able to move in the direction of the axial force applied by the user on shroud 122, the axial force applied by the user on shroud 122 causes both shroud 122 and lock ring 112 to move in the direction of the force. However, because of the friction between shroud 122 and lock ring 112, shroud 122 does not appreciably move relative to lock ring 112.

This movement of lock ring 112 will cause spring 114 to compress. Preferably, there is a limit to how far lock ring 112 can move relative to body 106 in the direction of the force F. For example, when surface 130 of lock ring 112 abuts shoulder 118, lock ring 112 will not be able to move in the direction of force F. When this occurs, the user should exert in the direction of connector 150 an axial force on shroud 122 where such axial force is greater than the force of friction between shroud 122 and lock ring 112. This force will cause shroud 122 to move relative to lock ring 122 in the direction of the force (see FIG. 3).

Figure 3:
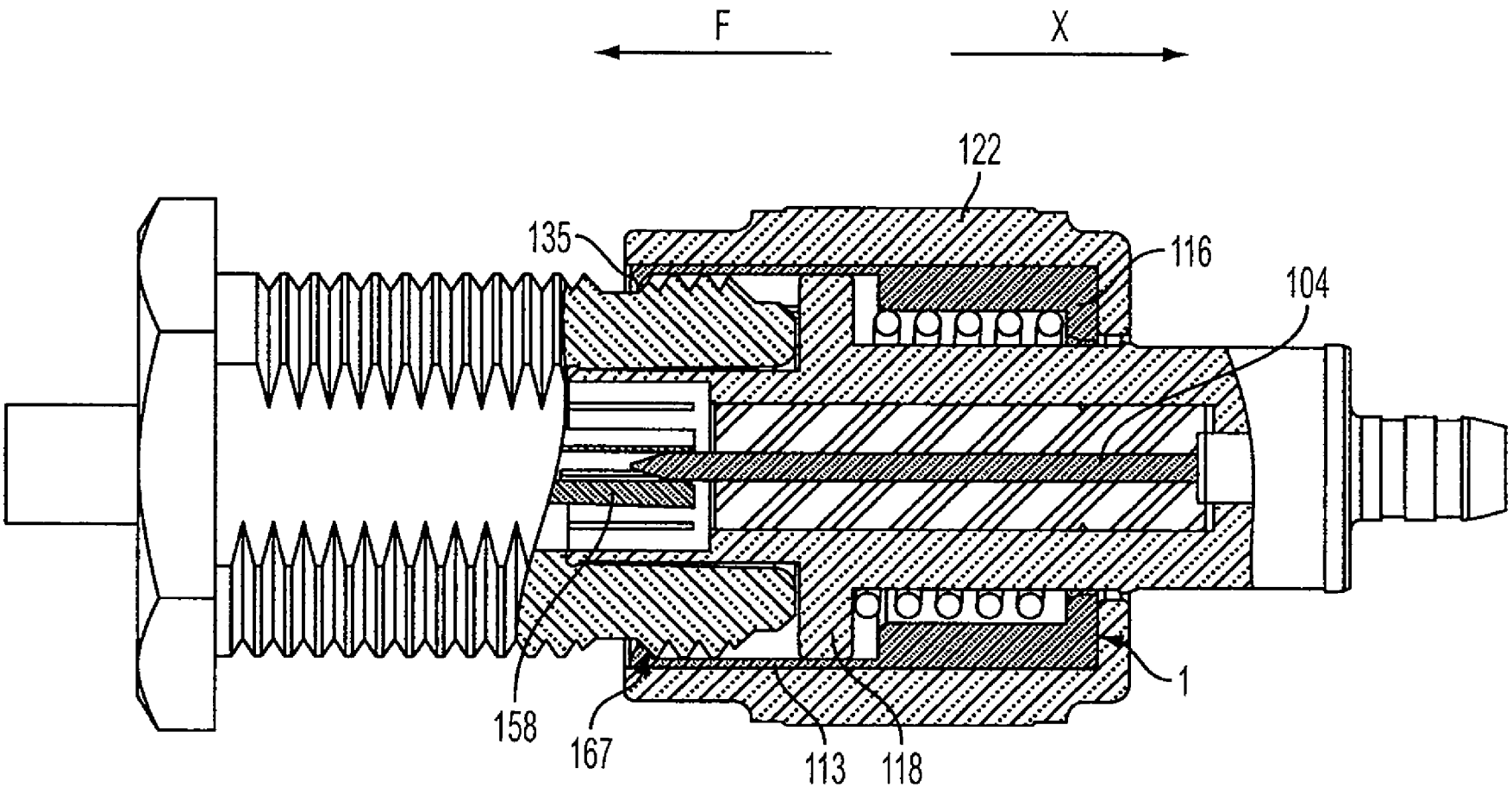
FIG. 3 shows connectors 102 and 150 in a fully mated state.
Figure 4:
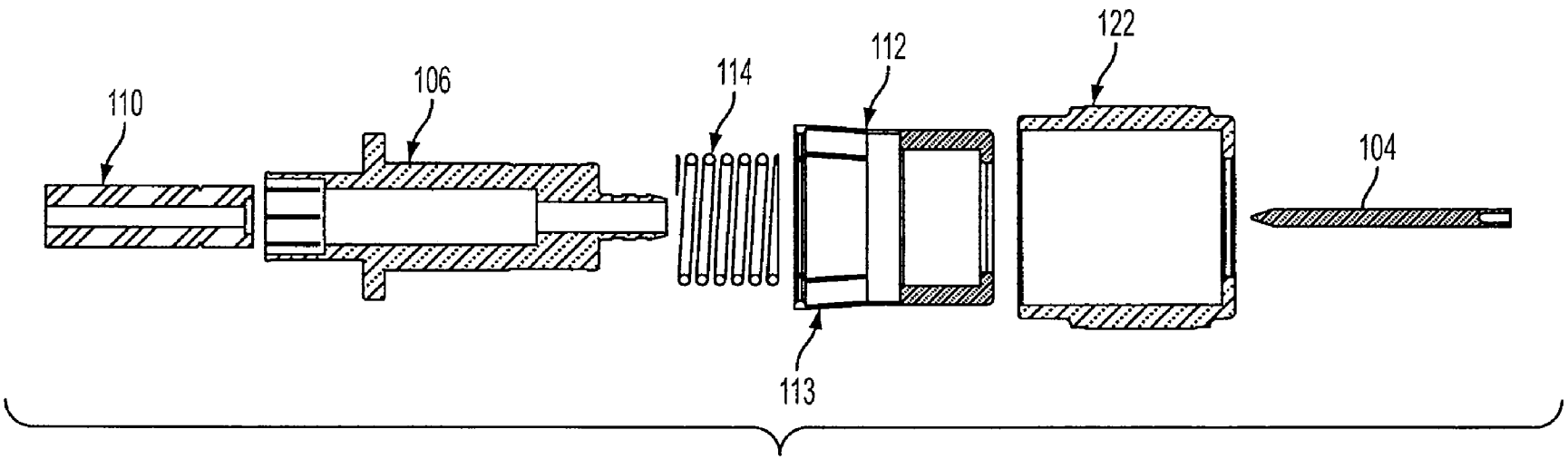
FIG. 4 is an exploded side view of connector 102.

When shroud 122 moves relative to lock ring 112 in the direction of the force and into its closed position, shroud 122 exerts an inward force on fingers 113 that forces the fingers to move inward (see FIG. 3). Preferably, when shroud 122 forces the fingers 113 inwardly, fingers 113 are positioned such that the lip 135 of the fingers 113 are positioned behind a thread or grip ring or other member 167 that projects outwardly from body 152 of connector 150, thereby locking connectors 150, 102 together.

In this locked position, spring 114 is compressed and therefore exerts a force on shoulder 116 in the direction of arrow X and force on shoulder 118 in the direction of arrow F. However, because lips 135 are positioned behind (i.e., engaged with) protuberance 167, the force exerted by spring 114 on shoulder 116 does not cause lock ring 112 to move because the protuberance 167 acts as a stopper, and the force exerted by spring 114 on shoulder 118 urges body 106 in the direction of arrow F so that mating face 108 of connector 102 presses against mating face 160 of connector 150. Additionally, as illustrated in FIG. 3, when in the locked position, contact 104 is received by contact 158.

There are several advantages of the above described embodiment of the connector system 100. For example, system 100 enables a user to easily mate and un-mate connectors 102 and 150. For example, in the embodiment described, the user need only push on shroud 122 in order to lock connectors 102 and 150 together. Another advantage is that the spring 114 maintains a constant force at the mating faces to keep them bottomed, and keeping the mating faces bottomed allows the connectors to have an uninterrupted ground path. An uninterrupted ground path allows the connectors to operate at higher frequencies and have improved electrical characteristics (e.g., VSWR and insertion loss).

Figure 5:
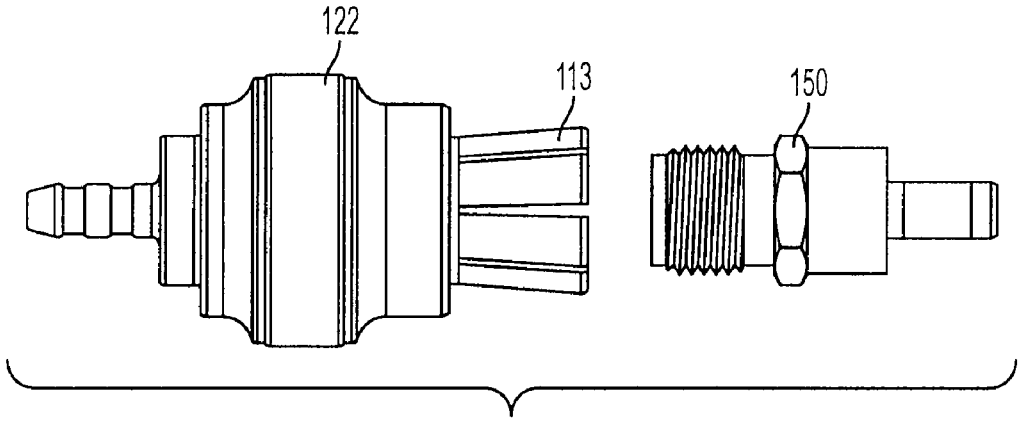
FIGS. 5-7 illustrate the process of mating connector 102 with connector 150.
Figure 6:
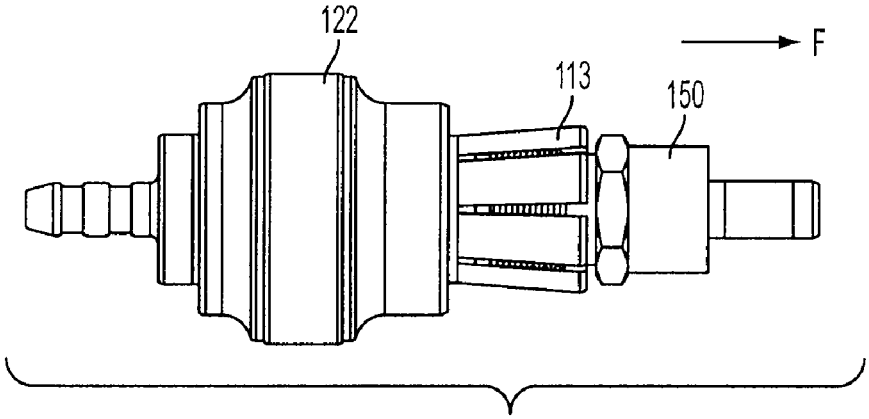
Figure 7:
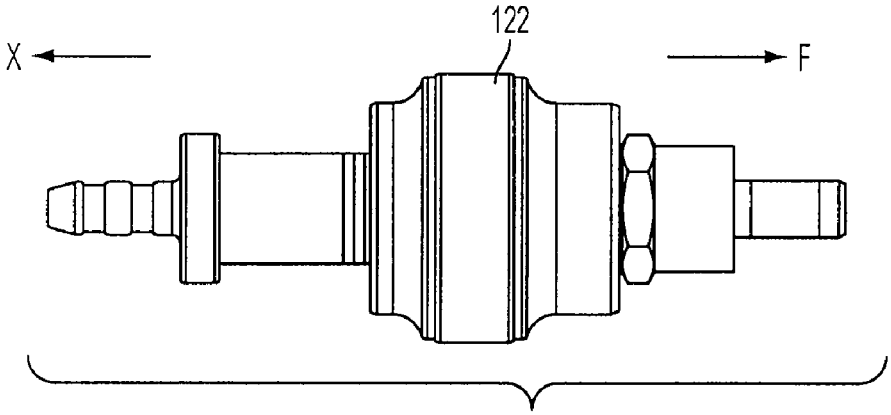

Referring now to FIGS. 5-7, these figures further illustrate the process of mating connector 102 with connector 150. To un-mate the connectors, the user need only pull back on shroud 122 so that shroud 122 moves relative to lock ring 112 and body 106 (i.e., shroud moves from its closed position to its open position). When shroud 122 moves in the direction of arrow X relative to lock ring 112, the shroud 122 no longer exerts the inward force on fingers 113. Thus, fingers 113 will expand outwardly (i.e., the lips of fingers will not be stopped by stopper 167) thereby enabling the user to disengage connector 102 from connector 150 by pulling on shroud 122.

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method for mating a first connector with a second connect connector, wherein the second connector comprises a generally cylindrical body, a generally cylindrical outer contact surrounding at least a portion of the body, the outer contact comprising an elongate portion tending to flare outwardly, a spring disposed between the outer contact and the body, and a shroud surrounding at least part of the outer contact, wherein the shroud is moveable along an axis that is generally parallel with a longitudinal axis of the body, the method comprising:

(a) positioning the second connector in front of the first connector;

(b) exerting a force on the shroud in the direction of the first connector so that a mating face of the body enters into a cavity defined by the first connector;

(c) after performing step (b), exerting a force on the shroud in the direction of the first connector to cause the outer contact to (i) move in the direction of the first connector relative to the body and (ii) compress the spring; and (d) after performing step (c), exerting a force on the shroud in the direction of the first connector to cause the shroud to move in the direction of the first connector relative to the outer contact so that the shroud exerts an inward force on the elongate portion, thereby causing the elongate portion to bend inwardly such that an end portion of the elongate portion is disposed behind a protuberance of the first connector.

2. The method of claim 1, wherein, after step (d) is performed, the spring exerts an axial force on the outer contact in a direction away from the first connector causing the end portion of the elongate portion to exert a substantially equal axial force on the protuberance.

3. The method of claim 1, wherein the second connector further comprises a male or female contact housed within the body of the second connector.

4. The method of claim 3, wherein the second connector further comprises an insulator configured to electrically insulate the contact housed within the body of the second connector from said body.

5. The method of claim 1, wherein the outer contact comprises a plurality of elongate portions.

6. The method of claim 1, wherein the second connector further comprises a retaining step for limiting the axial movement of the outer contact.

7. The method of claim 1, further comprising moving the shroud so that the shroud does not exert an inward force on the finger, thereby allowing the finger to flare outwardly, prior to performing step (a).

8. A connector, comprising:

a generally cylindrical body;

a generally cylindrical outer contact surrounding at least a portion of the body, the outer contact comprising a elongate portion, wherein the outer contact is moveable relative to the body along an axis that is generally parallel with a longitudinal axis of the body between a first position and a second position;

a spring disposed in a space between the outer contact and the body, wherein, when the outer contact is in the second position, the spring is compressed; and a shroud surrounding at least part of the outer contact, wherein the shroud is moveable relative to the body and relative to the outer contact along an axis that is generally parallel with the longitudinal axis of the body between an open position, in which the shroud does not exert an appreciable inward force on the elongate portion, and a closed position, in which the shroud exerts an appreciable inward force on the elongate portion that causes the elongate portion to bend inwardly.

9. The connector of claim 8, further comprising a retaining step projecting outwardly from an outer surface of said body and configured and positioned such as to limit the axial movement of the outer contact.

10. The connector of claim 8, wherein the outer contact comprises a plurality of elongate portions.

11. The connector of claim 8, further comprising a contact housed within the body.

12. The connector of claim 11, further comprising an insulator configured to electrically insulate the contact from the body.

13. The second connector of claim 8, wherein the elongate portion comprises a lip at its distal end, which lip is configured to engage a protuberance that projects outwardly from a body of a mating connector with which the second connector configured to mate when the second connector is mated with the mating connector.

14. A method for un-mating a first connector from a second connector, wherein the first connector has a member that projects outwardly from a body of the first connector, and the second connector comprises: (1) a generally cylindrical body housing a contact that is engaged with a contact housed within the body of the first connector, (2) a generally cylindrical outer contact surrounding at least a portion of the body of the second connector, the outer contact comprising a finger engaged with said member of the first connector, (3) a spring disposed between the outer contact and the body of the second connector, and (4) a shroud surrounding at least part of the outer contact, wherein the shroud is moveable along an axis that is generally parallel with a longitudinal axis of the body of the second connector, the method comprising:

(a) gripping the shroud;

(b) after step (a), exerting a force on the shroud in a direction away from the first connector so that the shroud moves relative to said outer contact in said direction to allow said finger to move outwardly and disengage the member, wherein, after said finger disengages the member, the spring automatically causes the outer contact to move in said direction away from the first connector; and (c) after step (b), disengaging the contact housed within the body of the second connector from the contact of the first connector.

15. The method of claim 14, wherein the contact housed within the body of the second connector is a male contact.

16. The method of claim 15, wherein the second connector further comprises an insulator configured to electrically insulate the contact housed within the body of the second connector from said body.

17. The method of claim 14, wherein the outer contact comprises a plurality of fingers.

18. The method of claim 14, wherein the second connector further comprises a retaining step for limiting the axial movement of the outer contact.

* * * * *